US012188326B2

(12) United States Patent
Kumar et al.

(10) Patent No.: US 12,188,326 B2
(45) Date of Patent: Jan. 7, 2025

(54) PLUG ELEMENT FACILITATING WELL FLOWBACK

(71) Applicant: Saudi Arabian Oil Company, Dhahran (SA)

(72) Inventors: Sanjiv Kumar, Udhailiyah (SA); Abdullah K. Alghannam, AlAhsa (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/305,921

(22) Filed: Apr. 24, 2023

(65) Prior Publication Data

US 2024/0352823 A1 Oct. 24, 2024

(51) Int. Cl.
*E21B 33/12* (2006.01)
*E21B 34/06* (2006.01)

(52) U.S. Cl.
CPC ..... *E21B 33/12* (2013.01); *E21B 34/06* (2013.01); *E21B 2200/05* (2020.05)

(58) Field of Classification Search
CPC ..... E21B 33/12; E21B 34/06; E21B 2200/05; E21B 34/063
See application file for complete search history.

(56) References Cited

U.S. PATENT DOCUMENTS

| | | | | |
|---|---|---|---|---|
| 5,901,787 | A | 5/1999 | Boyle | |
| 7,337,850 | B2 | 3/2008 | Contant | |
| 7,806,189 | B2 | 10/2010 | Frazier | |
| 8,905,139 | B2 | 12/2014 | Arizmendi, Jr. et al. | |
| 10,100,608 | B2 | 10/2018 | Fripp et al. | |
| 2007/0137869 | A1* | 6/2007 | MacDougall | E21B 34/066 166/321 |
| 2013/0240203 | A1* | 9/2013 | Frazier | E21B 34/063 166/192 |
| 2018/0363415 | A1 | 12/2018 | Frazier | |
| 2019/0316445 | A1* | 10/2019 | Fripp | E21B 41/0085 |
| 2019/0330958 | A1* | 10/2019 | Prather | E21B 34/063 |
| 2021/0054714 | A1* | 2/2021 | Nichols | E21B 33/1285 |
| 2022/0049575 | A1* | 2/2022 | Coon | E21B 34/103 |

* cited by examiner

*Primary Examiner* — Brad Harcourt
(74) *Attorney, Agent, or Firm* — Fish & Richardson P.C.

(57) ABSTRACT

A system and a method for clearing debris from the top of plug in a well are provided. In an exemplary system a plug for a well includes a cylindrical body, a sealing ring mounted in the cylindrical body, and a flapper valve disposed against the sealing ring in the cylindrical body. The plug also includes a torsion spring to open the flapper valve when a latch on the flapper valve is disengaged, a receiver to receive control signals, and an actuator controlled by the receiver to disengage the latch.

19 Claims, 5 Drawing Sheets

PLUG ELEMENT FACILITATING WELL FLOWBACK

TECHNICAL FIELD

This disclosure relates to methods of cleaning debris from the top of a plug in a well.

BACKGROUND

During the lifetime of a well, setting up plug is often needed. However, fill and debris may settle to the top of the plug, requiring expensive cleanout operations, for example, using a coiled tubing or even a workover operation.

SUMMARY

An embodiment described herein provides a plug for a well. The plug includes a cylindrical body, a sealing ring mounted in the cylindrical body, and a flapper valve disposed against the sealing ring in the cylindrical body. The plug also includes a torsion spring to open the flapper valve when a latch on the flapper valve is disengaged, a receiver to receive control signals, and an actuator controlled by the receiver to disengage the latch.

Another embodiment described herein provides a method to clear debris from the top of a plug in a well. The method includes placing a plug in the well, wherein the plug includes: a cylindrical body; a sealing ring mounted in the cylindrical body; a flapper valve disposed against the sealing ring in the cylindrical body; a torsion spring to open the flapper valve when a latch on the flapper valve is disengaged; a receiver to receive control signals; and an actuator controlled by the receiver to disengage the latch. The method also includes sending a signal to the receiver to disengage the latch, disengaging the latch, and opening the flapper valve with the torsion spring to allow flow from the well to push debris up the well.

DETAILED DESCRIPTION

Embodiments described herein provide a plug that includes an element to facilitate flowback to sweep debris from the top of the plug. The element is intended to be integral part of the plug. The element includes a flapper that is energized with a torsion spring to open the hole in the plug. An actuator connected to a signal receiver activates the flapper to allow the torsion spring to force the flapper to the open position, allowing the well to flow through the plug. Once the debris is removed, the plug can be retrieved. The removal of the debris from the top of the plug removes the need to use a coiled tubing cleanout procedure to remove the debris, lowering the cost of operation.

Figure 1:
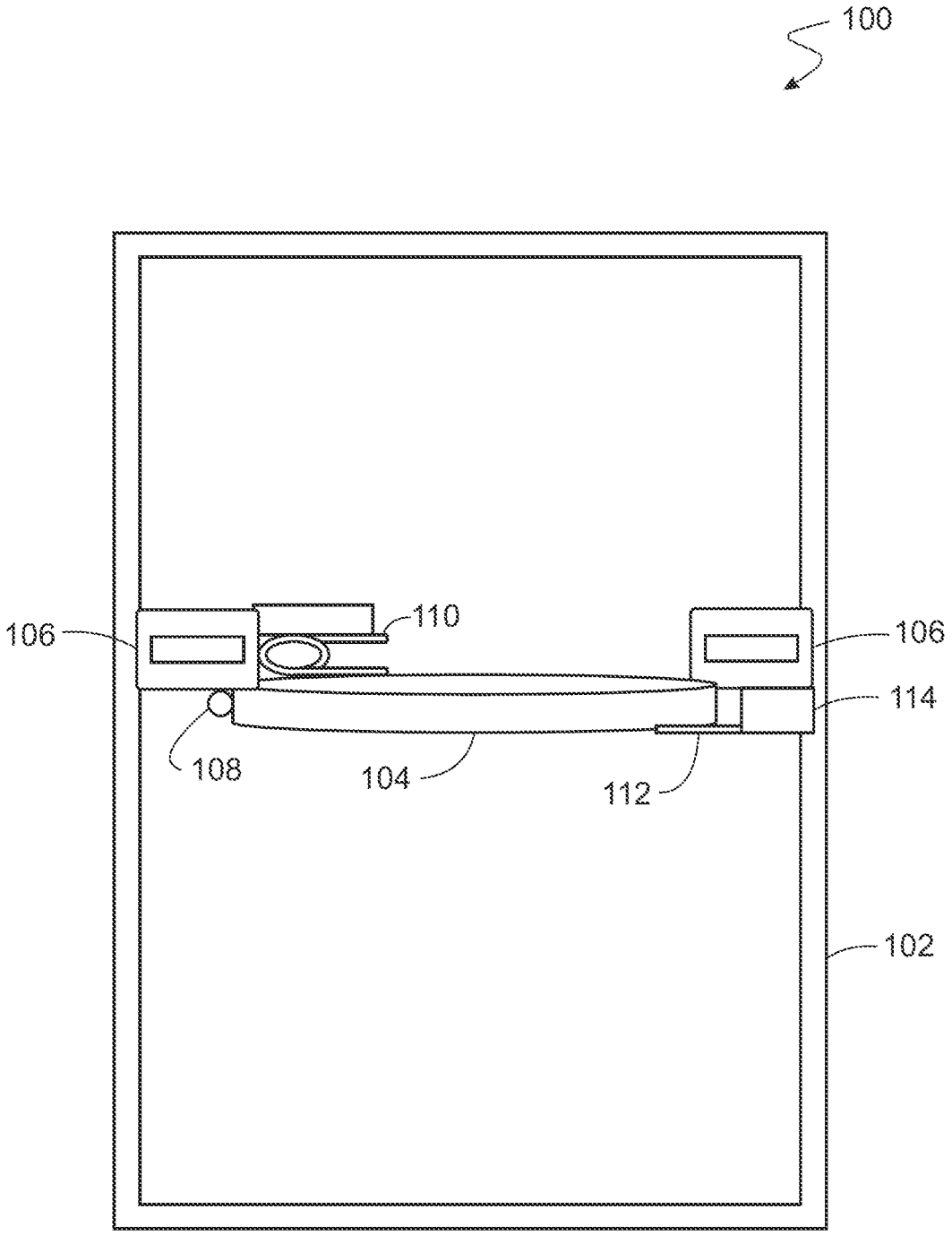
FIG. 1 is a drawing of a plug component having a spring-loaded flapper valve that can be released to open the plug.

FIG. 1 is a drawing of a plug 100 having a spring-loaded flapper valve 102 that can be released to open the plug 100. The plug 100 has a cylindrical body 102, for example, with threads to allow the plug 100 to be inserted or removed using normal tools. The flapper 104 comprises a thin cylindrical plate. In various embodiments, the flapper 104 may be made from steel, aluminum, magnesium, a hard plastic, or a combination thereof. In the closed position, the flapper 104 is in contact with a sealing ring 106 that is mounted in the cylindrical body. In some embodiments, the sealing ring 106 is an elastomer that blocks flow when the flapper 104 is in the closed position. In various embodiments, the elastomer is an elastomeric epoxy, an elastomeric urethane, a nitrile rubber, or a cross-linked rubber, among others.

In some embodiments, the flapper 104 is coupled to the sealing ring 106 with a hinge 108, or other device to allow the flapper 104 to pivot. A torsion spring 110 is placed above the flapper 104 to open the flapper 104, which is held in place by a latch 112. A receiver 114 is configured to receive signals, for example, wirelessly or through pressure pulses received through a water column, such as mud pulse telemetry. When the receiver 114 receives a signal to open the flapper 104, it activates an actuator, which moves the latch 112 out-of-the-way, allowing the flapper 104 to open. The actuator can be a solenoid or a motor. As described with respect to FIGS. 2-4, this allows flow from the well to sweep debris up the well.

In some embodiments, a wireless sender bottom hole assembly (BHA) is placed in the well to send the signal to the receiver 114. In other embodiments, a sonic generator is placed at the top of the well to issue pressure pulses into the liquid column, providing the signal to the receiver 114. In this embodiment, the receiver 114 includes a detector, such as an ultrasonic transceiver, to detect the pulses in the liquid.

In some embodiments, the receiver 114 has a sensor to detect when the flapper 104 is closed, for example, due to an increase in flow from the well. The sensor may be a magnetic sensor, such as a coil in the sealing ring 106, an optical sensor, and the like. If the receiver 114 detects that the flapper 104 is closed and the latch 112 is withdrawn, the receiver 114 may be configured to reengage the latch 112, preventing vibration, or chattering, of the flapper 104.

Figure 2:
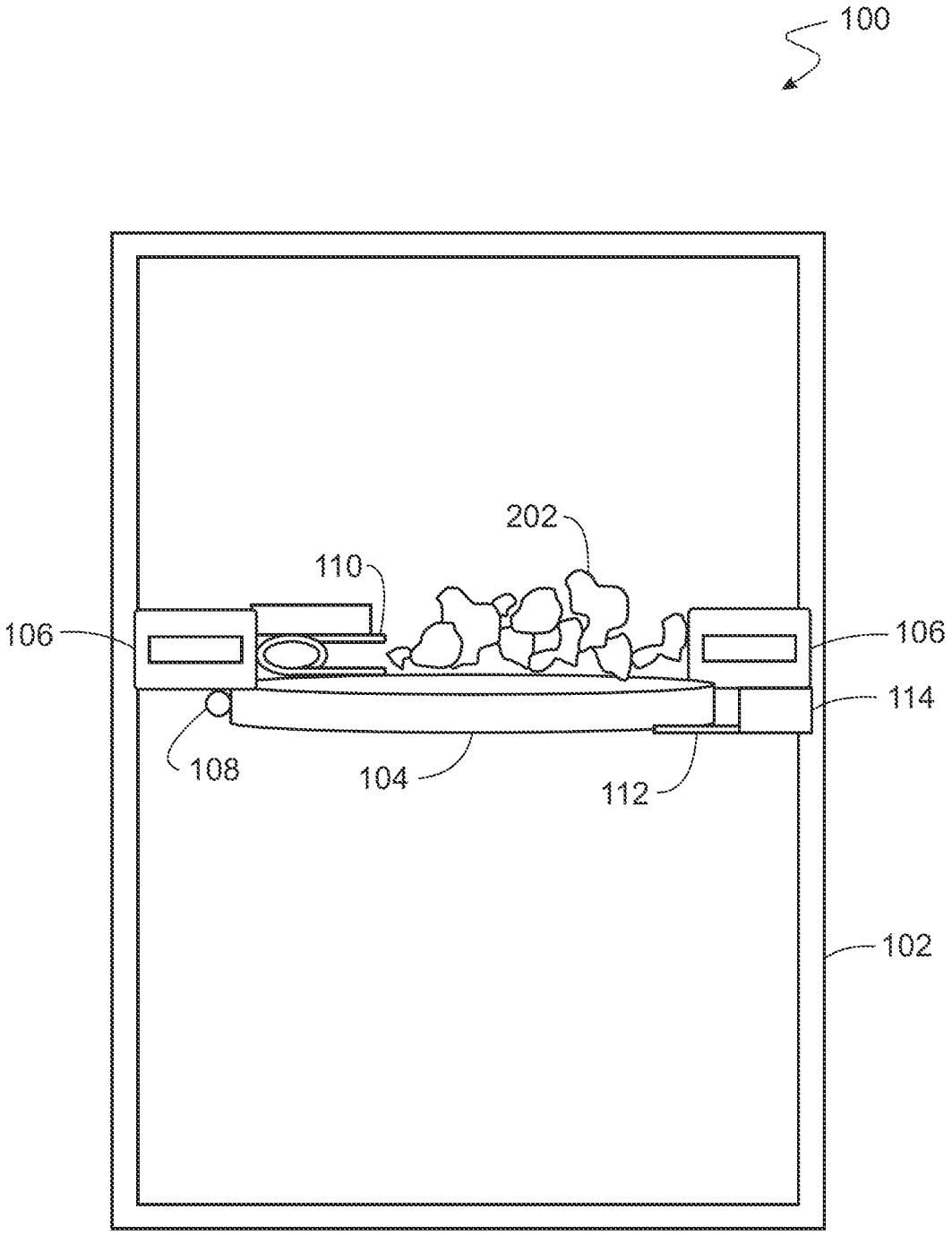
FIG. 2 is a schematic drawing of the plug, showing flapper in the closed, or sealed, position, with debris that has accumulated on the top of the flapper.

FIG. 2 is a schematic drawing of the plug 100, showing flapper 104 in the closed, or sealed, position, with debris 202 that has accumulated on the top of the flapper 104. Like numbered items are as described with respect to FIG. 1. After the plug is placed in the well, debris 202, such as fill, rock shavings, sand, and the like, may accumulate on the flapper 104.

Figure 3:
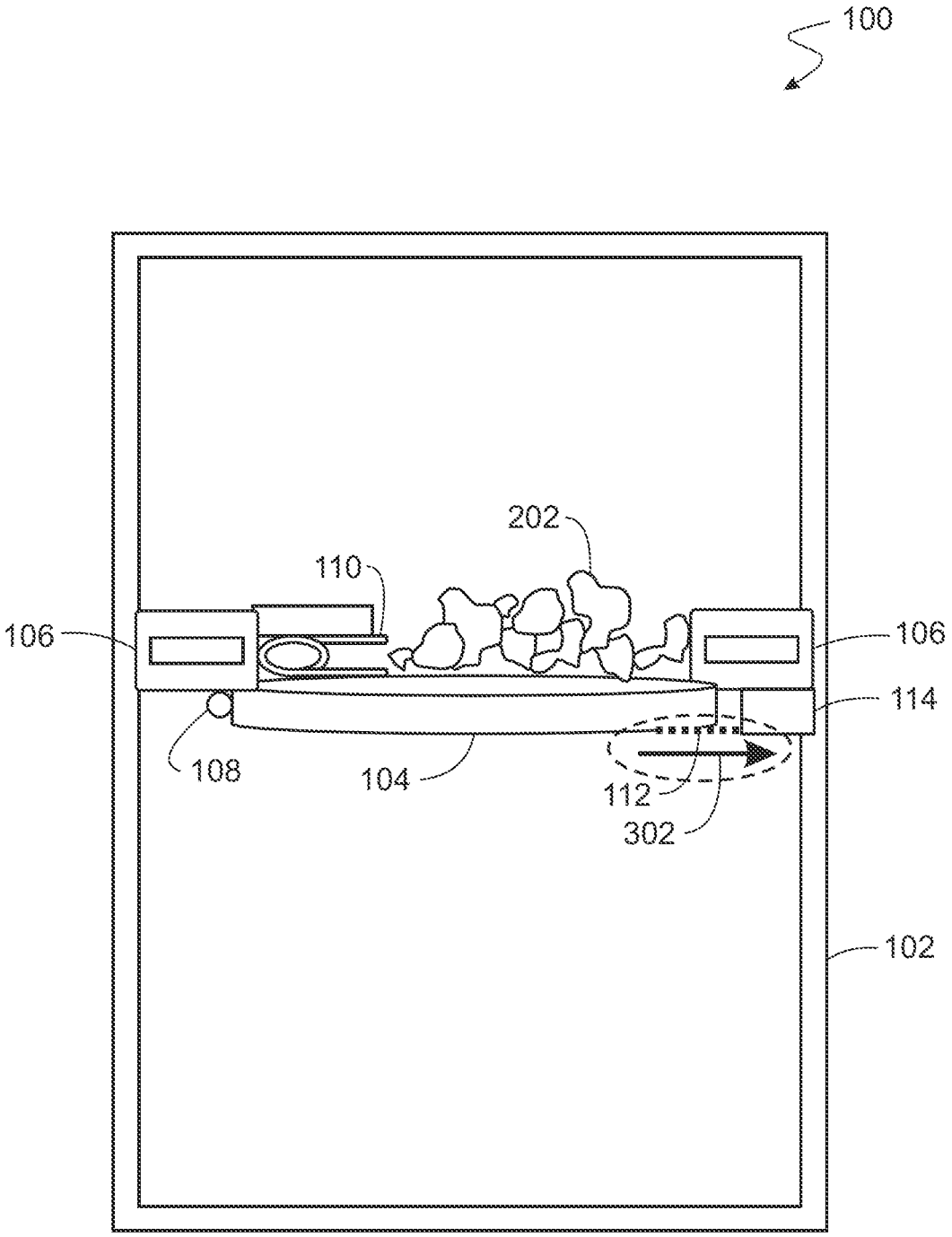
FIG. 3 is a schematic drawing of the plug, illustrating the withdrawal of the latch from the flapper by the receiver.

FIG. 3 is a schematic drawing of the plug 100, illustrating the withdrawal of the latch 112 from the flapper 104 by the receiver 114. Like numbered items are as described with respect to FIGS. 1 and 2. In the case of debris 202 accumulating on top of the flapper 104, a signal, such as a wireless signal, is sent to the receiver 114. Upon getting the signal, the receiver 114 disengages the latch 112 from the flapper 104, as indicated by the arrow 302. The torsion spring 110 will then push the flapper 104 open. As indicated, in this embodiment, the flapper 104 opens against the well flow. In some embodiments, the torsion spring 110 is sized to open the flapper 104 against the highest expected pressure. In some embodiments, the torsion spring 110 is sized so that an increase in flow rate from the well will close the flapper 104.

Figure 4:
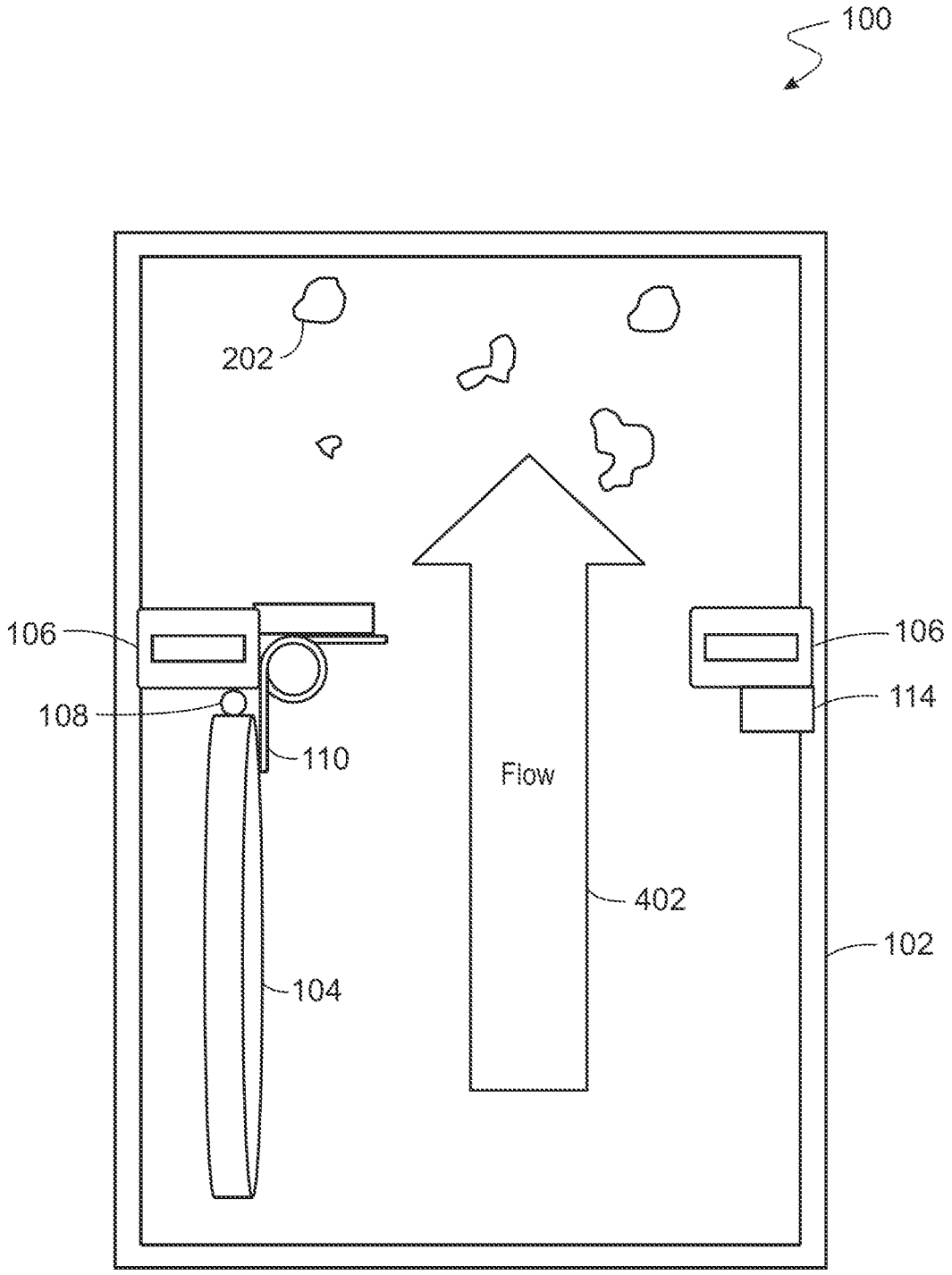
FIG. 4 is a schematic drawing of the plug with the flapper in the open position, allowing flow up through the center of the plug.

FIG. 4 is a schematic drawing of the plug 100 with the flapper 104 in the open position, allowing flow up through the center of the plug 100. Like numbered items are as described with respect to FIGS. 1 and 2. Once the flapper 104 opens, the flow 402 from the well will lift the debris 202 out of the well through flowback. Once the debris 202 is removed, a retrieving tool can be run into the well to remove the plug 100. This will avoid an expensive fill clean out operation, for example, using coiled tubing or even a workover operation.

Figure 5:
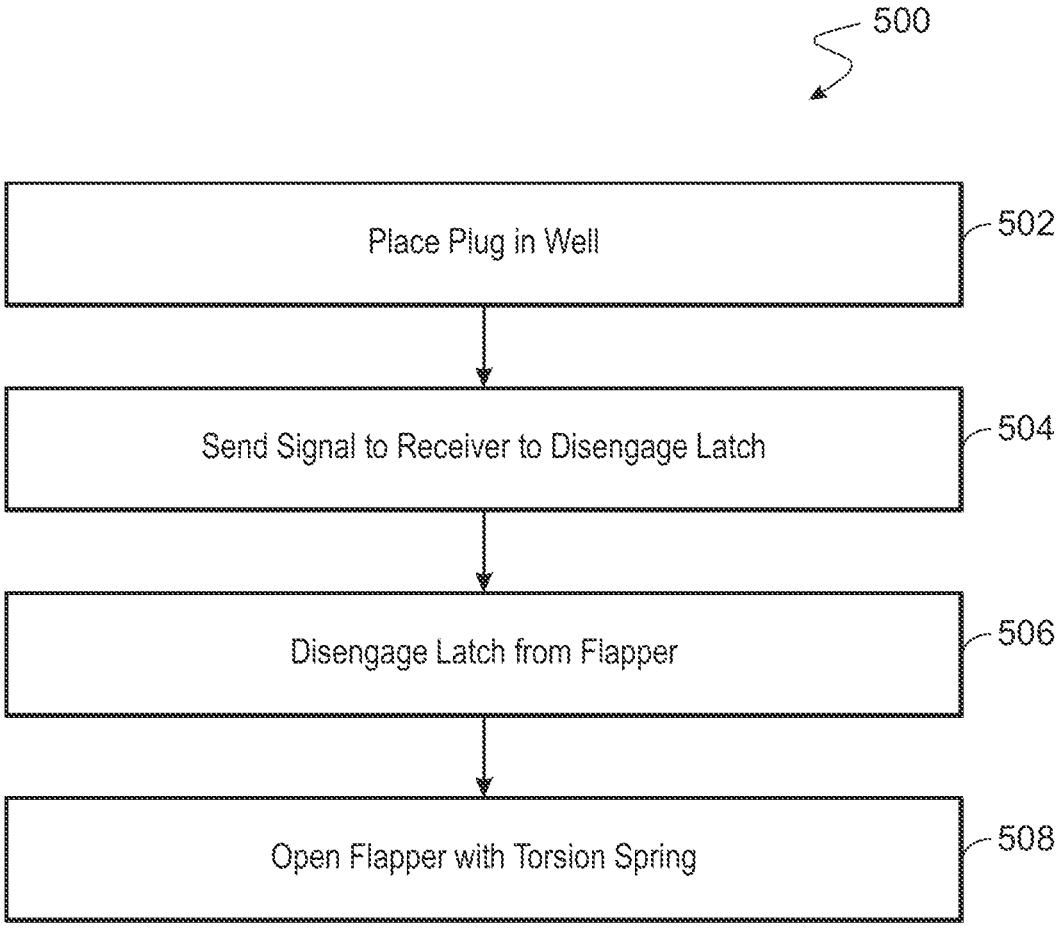
FIG. 5 is a process flow diagram of a method for clearing debris from the top of the plug using a spring-loaded flapper valve.

FIG. 5 is a process flow diagram of a method 500 for clearing debris from the top of the plug using a spring-loaded flapper valve. The method 500 begins at block 502, when the plug is placed in the well. At block 504, after the plug is set and surface remedial work is completed, a signal is sent to a receiver in the plug to disengage a latch holding the spring-loaded flapper valve in place. As described herein, the signal may be a wireless signal provided by a bottom hole adapter that includes a wireless transmitter. Further, depending on the depth, a wireless signal may be sent from the surface, or through the well itself. In some embodiments, a mud pulse telemetry signal may be sent from the surface through a fluid column to the plug.

At block 506, once the receiver has received the signal, it disengages the latch from the flapper. At block 508, the flapper is opened by the torsion spring. This allows fluids to flow up from the well, and sweep debris from the top of the plug out of the well through a flowback procedure. Depending on the flow rate and pressure, the flapper may be pushed closed by the fluids flowing from the well. In some embodiments, a sensor in the receiver, such as an optical sensor, will detect that the flapper is closed, and reengage the latch.

Once the debris is swept from the top of the plug, the plug can be removed from the well using standard tools. The flowback procedure using the flapper valve in the plug decreases or eliminates the need to use a cleanup procedure, for example, with a coiled tubing. This lowers the cost of completion of the well.

Embodiments

An embodiment described herein provides a plug for a well. The plug includes a cylindrical body, a sealing ring mounted in the cylindrical body, and a flapper valve disposed against the sealing ring in the cylindrical body. The plug also includes a torsion spring to open the flapper valve when a latch on the flapper valve is disengaged, a receiver to receive control signals, and an actuator controlled by the receiver to disengage the latch.

In an aspect, combinable with any other aspect, the sealing ring includes a hinge coupled to the flapper valve, wherein the hinge is disposed proximate to the torsion spring.

In an aspect, combinable with any other aspect, the sealing ring includes a hydrocarbon-resistant elastomer.

In an aspect, combinable with any other aspect, the flapper valve is disposed to open against flow from the well.

In an aspect, combinable with any other aspect, the torsion spring is sized to open the flapper valve against pressure in the well.

In an aspect, combinable with any other aspect, the torsion spring is sized less than a highest pressure of the well.

In an aspect, combinable with any other aspect, the flapper valve is closed by flow from the well.

In an aspect, combinable with any other aspect, the receiver includes a wireless receiver.

In an aspect, combinable with any other aspect, the receiver includes an ultrasonic detector to receive pressure signals from the surface.

In an aspect, combinable with any other aspect, the actuator includes a solenoid that moves the latch.

In an aspect, combinable with any other aspect, the actuator includes a motor that moves the latch.

In an aspect, combinable with any other aspect, the actuator includes a sensor to determine if the flapper valve is closed.

In an aspect, combinable with any other aspect, the actuator is configured to engage the latch if the latch is open and the flapper valve is closed.

Another embodiment described herein provides a method to clear debris from the top of a plug in a well. The method includes placing a plug in the well, wherein the plug includes: a cylindrical body; a sealing ring mounted in the cylindrical body; a flapper valve disposed against the sealing ring in the cylindrical body; a torsion spring to open the flapper valve when a latch on the flapper valve is disengaged; a receiver to receive control signals; and an actuator controlled by the receiver to disengage the latch. The method also includes sending a signal to the receiver to disengage the latch, disengaging the latch, and opening the flapper valve with the torsion spring to allow flow from the well to push debris up the well.

In an aspect, combinable with any other aspect, the method includes threading a communications line down the well.

In an aspect, combinable with any other aspect, the method includes sending the signal from the communications line to the receiver.

In an aspect, combinable with any other aspect, the method includes sending pressure signals through a liquid column.

In an aspect, combinable with any other aspect, the method includes detecting if the flapper valve is not open.

In an aspect, combinable with any other aspect, the method includes engaging the latch if the flapper valve is not open.

In an aspect, combinable with any other aspect, the method includes activating a solenoid to move the latch.

Other implementations are also within the scope of the following claims.

What is claimed is:

1. A plug for a well, comprising:

a cylindrical body;

a sealing ring mounted in the cylindrical body;

a flapper valve disposed against the sealing ring in the cylindrical body;

a torsion spring configured to open the flapper valve in a downhole direction against a fluid flow in an uphole direction, the torsion spring configured to open the flapper valve when a latch on the flapper valve is disengaged;

a receiver to receive control signals; and an actuator controlled by the receiver to disengage the latch.

2. The plug of claim 1, wherein the sealing ring comprises a hinge coupled to the flapper valve, wherein the hinge is disposed proximate to the torsion spring.

3. The plug of claim 1, wherein the sealing ring comprises a hydrocarbon-resistant elastomer.

4. The plug of claim 1, wherein the torsion spring is sized to open the flapper valve against flow back pressure in the well.

5. The plug of claim 1, wherein the torsion spring is sized less than a highest pressure of the well.

6. The plug of claim 5, wherein the flapper valve is closed by flow from the well.

7. The plug of claim 1, wherein the receiver comprises a wireless receiver.

8. The plug of claim 1, wherein the actuator comprises a solenoid that moves the latch.

9. The plug of claim 1, wherein the actuator comprises a motor that moves the latch.

10. A plug for a well, comprising:

a cylindrical body;

a sealing ring mounted in the cylindrical body;

a flapper valve disposed against the sealing ring in the cylindrical body;

a torsion spring to open the flapper valve when a latch on the flapper valve is disengaged;

a receiver to receive control signals; and an actuator controlled by the receiver to disengage the latch wherein the receiver comprises an ultrasonic detector to receive pressure signals from the surface.

11. A plug for a well, comprising:

a cylindrical body;

a sealing ring mounted in the cylindrical body;

a flapper valve disposed against the sealing ring in the cylindrical body;

a torsion spring to open the flapper valve when a latch on the flapper valve is disengaged;

a receiver to receive control signals; and an actuator controlled by the receiver to disengage the latch, wherein the actuator comprises a sensor to determine if the flapper valve is closed.

12. The plug of claim 11, wherein the actuator is configured to engage the latch if the latch is open and the flapper valve is closed.

13. A method to clear debris from the top of a plug in a well, comprising:

placing a plug in the well, wherein the plug comprises:

a cylindrical body;

a sealing ring mounted in the cylindrical body;

a flapper valve disposed against the sealing ring in the cylindrical body;

a torsion spring to open the flapper valve in a downhole direction against fluid flow in an uphole direction, the torsion spring configured to open the flapper valve when a latch on the flapper valve is disengaged;

a receiver to receive control signals; and an actuator controlled by the receiver to disengage the latch;

sending a signal to the receiver to disengage the latch;

disengaging the latch; and opening the flapper valve with the torsion spring in the downhole direction against the fluid flowing in the uphole direction to allow flow from the well to push debris up the well.

14. The method of claim 13, comprising threading a communications line down the well.

15. The method of claim 14, comprising sending the signal from the communications line to the receiver.

16. The method of claim 13, comprising sending pressure signals through a liquid column.

17. The method of claim 13, comprising activating a solenoid to move the latch.

18. A method to clear debris from the top of a plug in a well, comprising:

placing a plug in the well, wherein the plug comprises:

a cylindrical body;

a sealing ring mounted in the cylindrical body;

a flapper valve disposed against the sealing ring in the cylindrical body;

a torsion spring to open the flapper valve when a latch on the flapper valve is disengaged;

a receiver to receive control signals; and an actuator controlled by the receiver to disengage the latch;

sending a signal to the receiver to disengage the latch;

disengaging the latch; and opening the flapper valve with the torsion spring to allow flow from the well to push debris up the well, further comprising detecting if the flapper valve is not open.

19. The method of claim 18, comprising engaging the latch if the flapper valve is not open.

* * * * *